US006715215B1

(12) United States Patent
Yeung

(10) Patent No.: US 6,715,215 B1
(45) Date of Patent: Apr. 6, 2004

(54) ELECTRIC HAIR DRYER

(75) Inventor: Ki Cheong Yeung, Sai Yong Poon (HK)

(73) Assignee: Sun Luen Electrical Mfg. Co. Ltd., Kowloon (HK)

( * ) Notice: Subject to any disclaimer, the term of this patent is extended or adjusted under 35 U.S.C. 154(b) by 0 days.

(21) Appl. No.: 10/396,282

(22) Filed: Mar. 24, 2003

(51) Int. Cl.[7] ..... A45D 24/10
(52) U.S. Cl. ..... 34/96; 34/97; 392/380
(58) Field of Search ..... 34/96, 97, 98, 34/283; 392/379, 380, 383, 384, 385

(56) References Cited

U.S. PATENT DOCUMENTS 4,308,670 A * 1/1982 Bonnema ..... 34/97
4,365,141 A * 12/1982 Weiss ..... 219/370
5,216,822 A * 6/1993 Madiedo ..... 34/82
5,839,204 A * 11/1998 Cinque et al. ..... 34/97

* cited by examiner

*Primary Examiner*—Henry Bennett
*Assistant Examiner*—Camtu Nguyen
(74) *Attorney, Agent, or Firm*—Smith-Hill and Bedell, P.C

(57) ABSTRACT

There is disclosed an electric hair dryer (10) including a body (12) with a rear end (16) allowing entry of air into the body (12), a front end (18) allowing exit of the air from the body (12), two cover plates (20) secured with the body (12), in which the cover plates (20) are movable between a first position in which at least part of the rear end (16) is blocked by the cover plates (20) and a second position in which the rear end (16) is unobstructed by the cover plates (20).

12 Claims, 6 Drawing Sheets

ELECTRIC HAIR DRYER

BACKGROUND OF THE INVENTION

During operation of an electric hair dryer, air from the outside environment is drawn into the interior of a body portion via an air inlet at the rear end of the body portion, and is forced out of the body portion via an air outlet at the front end of the body portion, by a fan in the body portion. To prevent dust in the air from entering into the interior of the body portion, a filter cover is provided at the rear end of the body portion to at least partially cover the air inlet for trapping the dust in the air, while allowing air to pass through. However, it is very difficult to remove the dust from the cover and to clean the cover. Some thus provide for a removable cover. This will, on the other hand, increase the chance of losing the cover.

It is thus an object of the present invention to provide an electric hair dryer in which the above shortcomings are mitigated or at least to provide a useful alternative to the public.

It is a further object of the present invention to provide an electric hair dryer with a back cover which is easy to clean, yet not easily lost.

SUMMARY OF THE INVENTION

According to the present invention, there is provided an electric hair dryer including a body with a first end allowing entry of air into said body, a second end allowing exit of said air from said body, and at least a cover member secured with said body and movable relative to said body between a first position in which at least part of said first end is blocked by said cover member and a second position in which said first end is substantially unobstructed by said cover member.

BRIEF DESCRIPTION OF THE DRAWINGS

A preferred embodiment of the present invention will now be described, by way of example only, with reference to the accompanying drawings, in which.

DETAILED DESCRIPTION OF THE PREFERRED EMBODIMENT

Figure 1A:
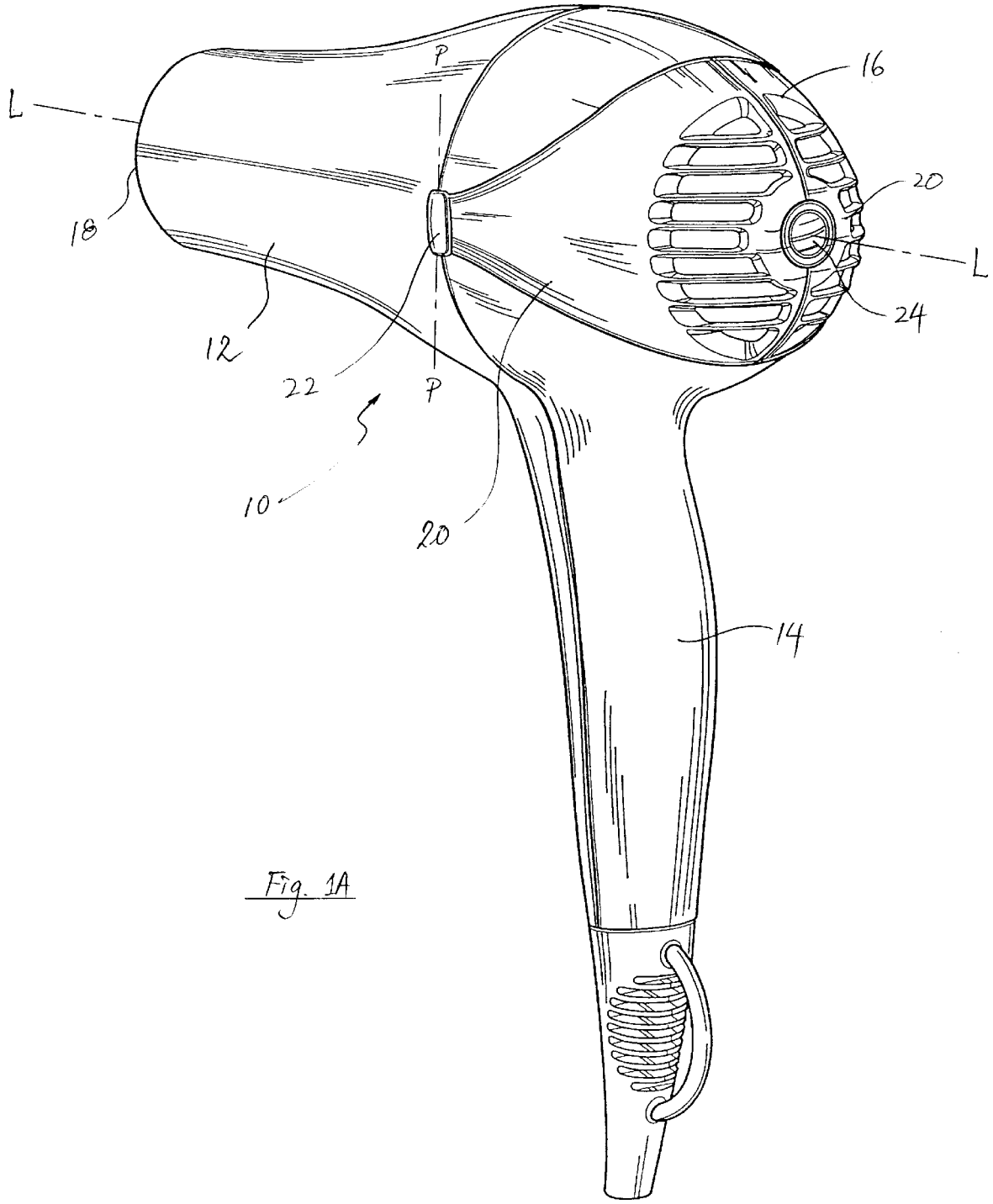
FIG. 1A is a rear perspective view of an electric hair dryer according to the present invention in which the cover plates are in the closed position.
Figure 1B:
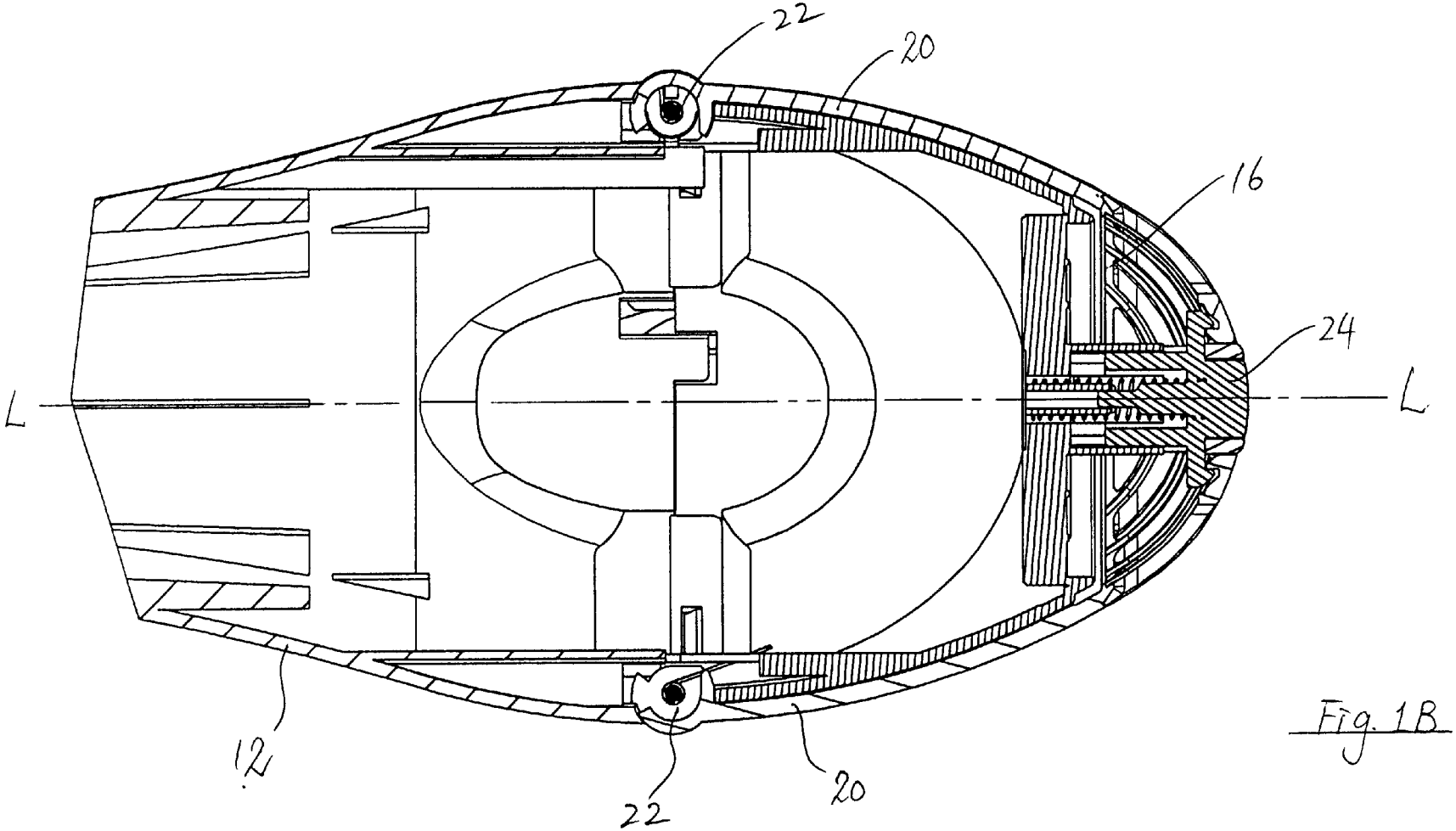
FIG. 1B is an enlarged transverse sectional view of the rear part of the body of the electric hair dryer shown in FIG. 1A, in which the internal components are removed for clarity purpose.

Referring to FIGS. 1A and 1B, an electric hair dryer according to the present invention is shown and generally designated as 10. The hair dryer 10 includes a generally cylindrical body 12 and a handle 14. The body 12 has a rear air entry end 16, from which air from the outside environment is drawn into the interior of the body 12 by a fan (not shown) in the body 12, and a front exit end 18 from which air drawn into the interior of the body 12 is forced out of the body 12 by the fan. An electric heating coil (not shown) is provided in the body 12 for selectively heating up the air drawn into the body 12.

At the rear end 16 of the body 12 are two cover plates 20, each secured to a respective side of the body 12 by a respective hinge 22 for pivotal movement about a respective axis P-P, which is perpendicular to a longitudinal axis L-L of the body 12. The movement of the cover plates 20 is controlled by the operation of a button 24.

Figure 2:
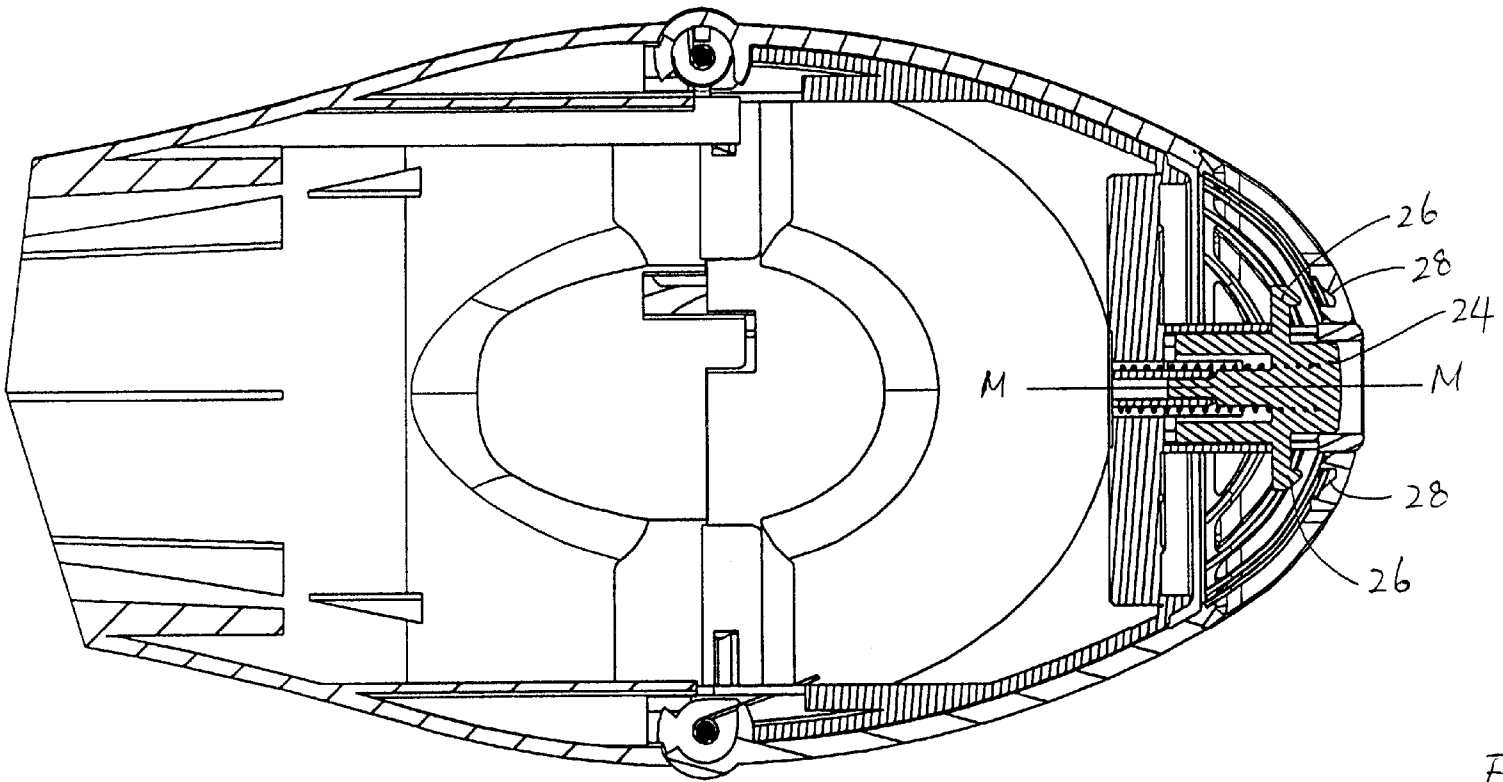
FIG. 2 is an enlarged transverse sectional view of the rear part of the body of the electric hair dryer shown in FIG. 1B in which the button is in the unlocked position.

It can be seen from FIG. 2 that the button 24 may be pushed inwardly towards the body 12 along its longitudinal axis M-M, which is parallel to the longitudinal axis L-L of the body 12 of the hair dryer 10, as shown in FIG. 1A. The button 24 includes two hooks 26 which, when in the position as shown in FIG. 1A, engage two complementary recesses 28, each on an inner surface of a respective cover plate 20, for retaining the cover plates 20 in the closed position as shown in FIG. 1A. When, however, the button 24 is moved to the position as shown in FIG. 2, the hooks 26 are disengaged from the recesses 28, thus unlocking the cover plates 20 for pivotal movement.

Figure 3:
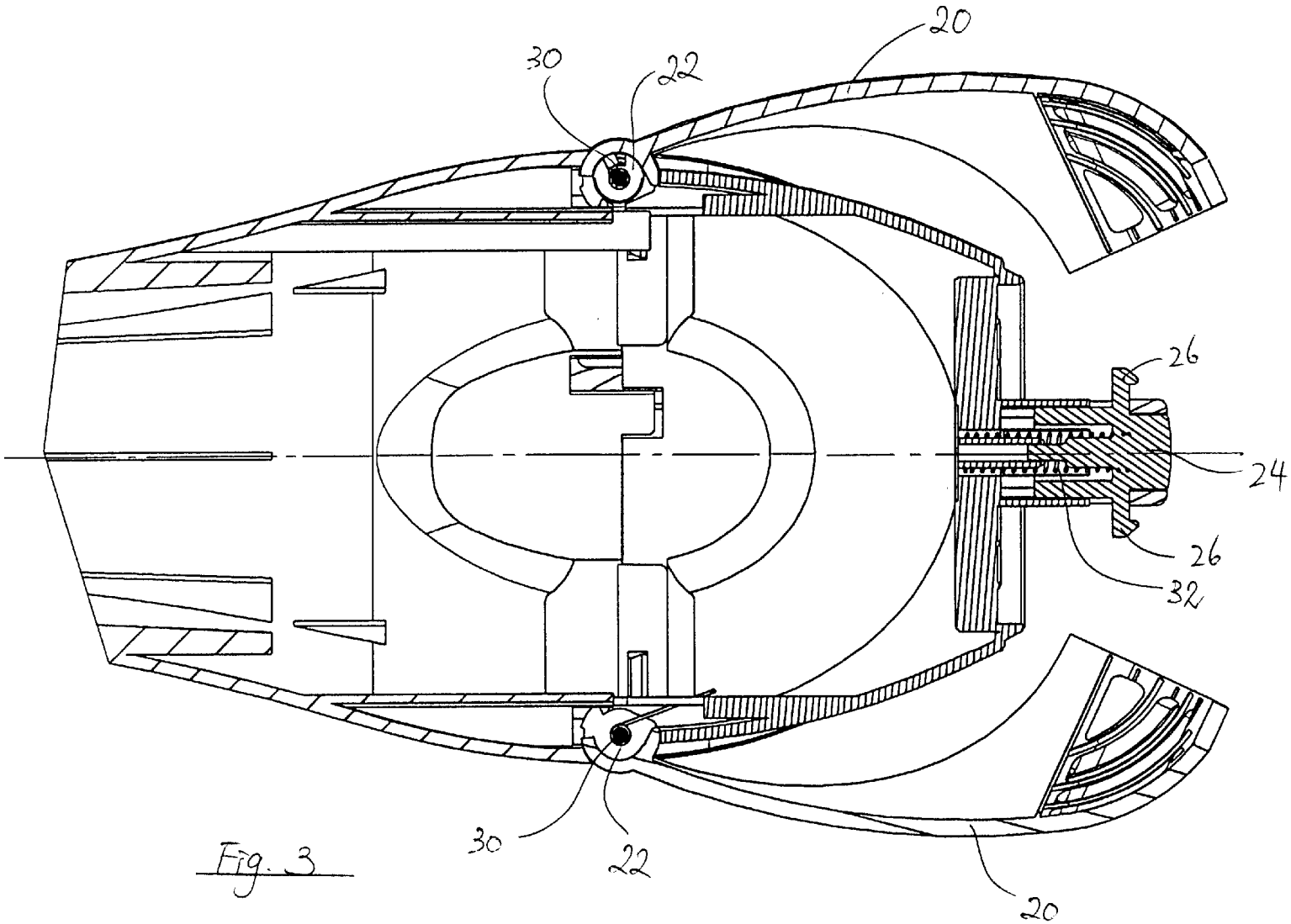
FIG. 3 is an enlarged transverse sectional view of the rear part of the body of the electric hair dryer shown in FIG. 1B in which the cover plates are in the partially open position.
Figure 4A:
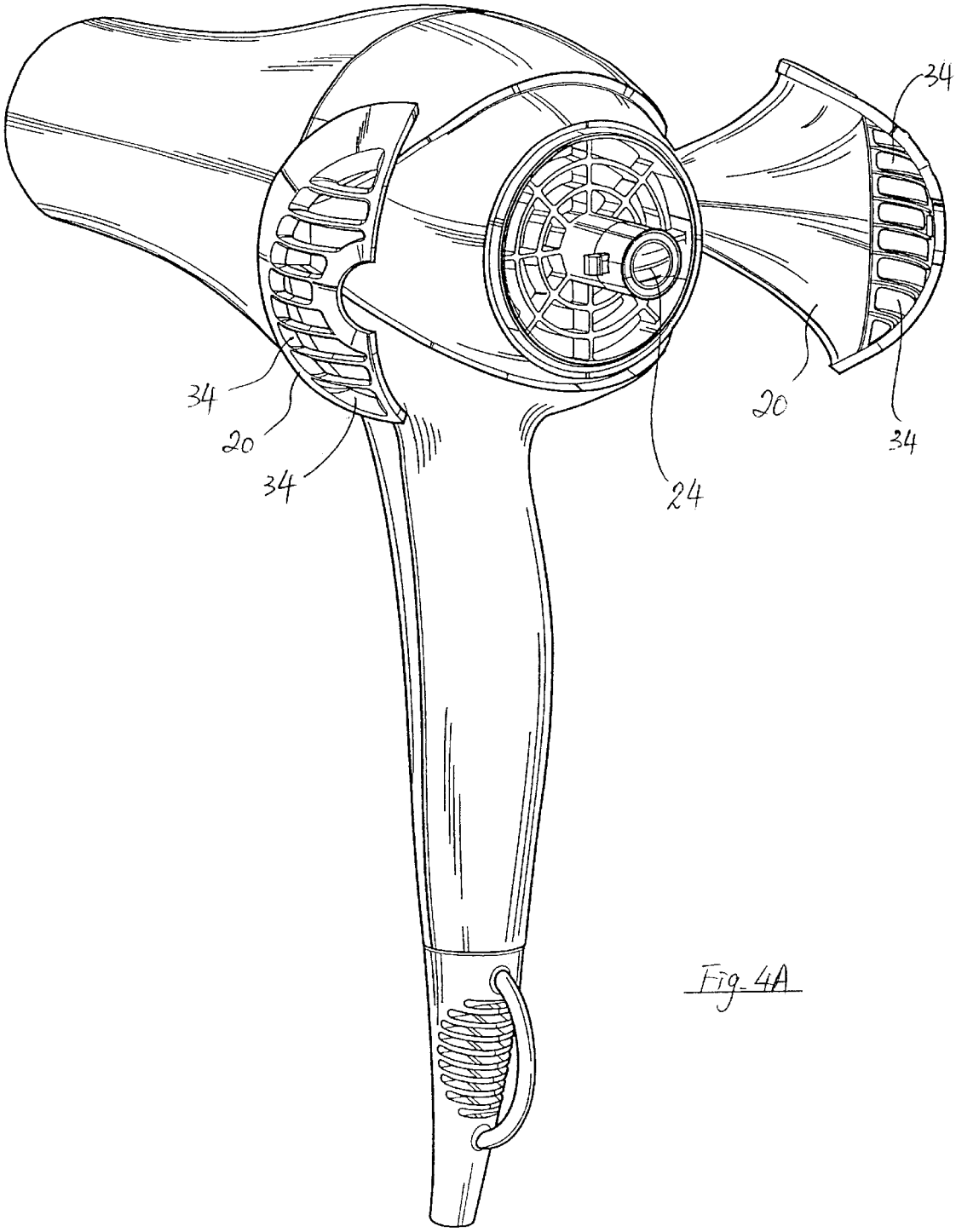
FIG. 4A is a rear perspective view of the electric hair dryer shown in FIG. 1A in which the cover plates are in the fully open position.
Figure 4B:
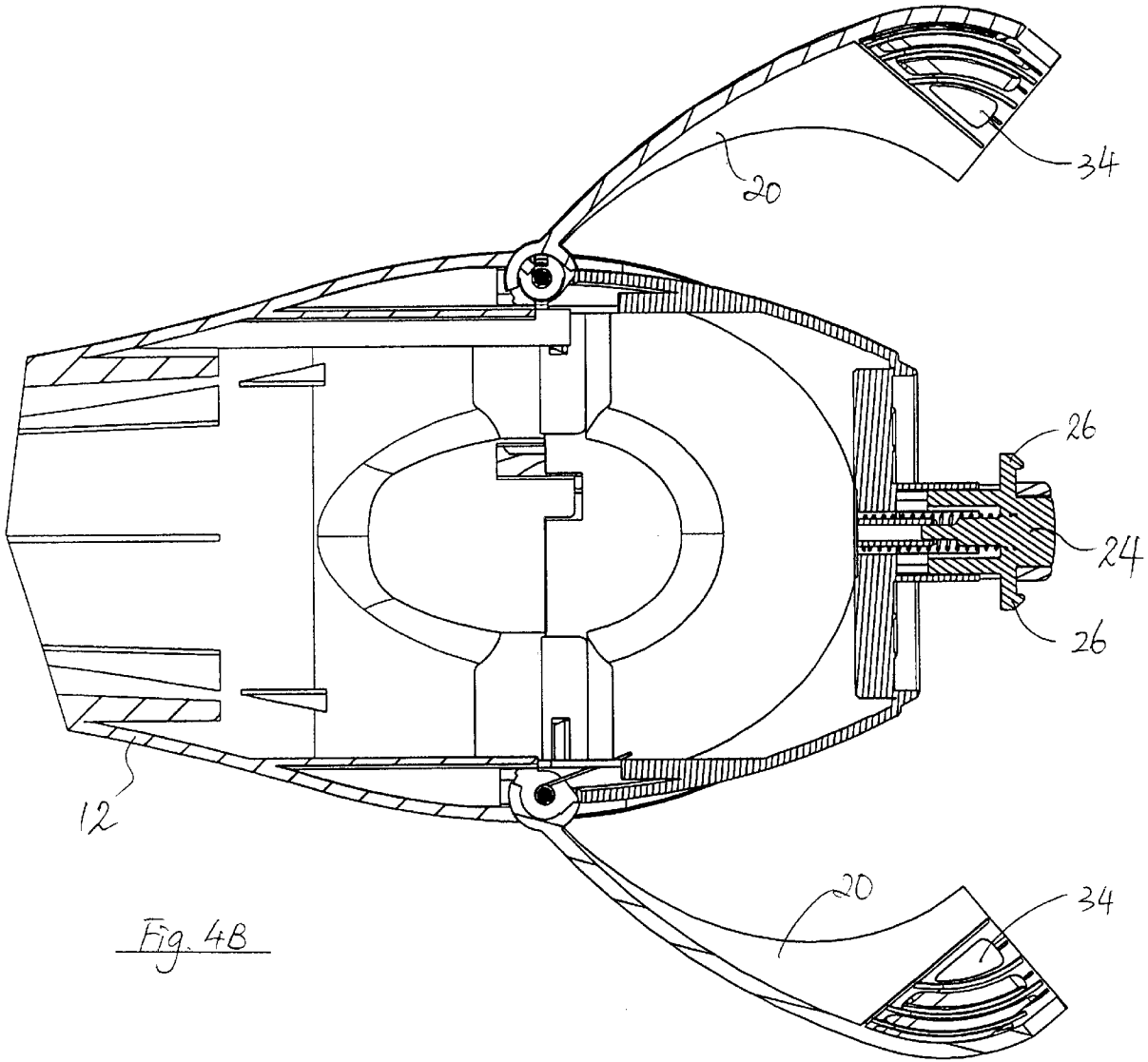
FIG. 4B is an enlarged transverse sectional view of the rear part of the body of the electric hair dryer shown in FIG. 4A.

Turning now to FIG. 3, when the hooks 26 of the button 24 are disengaged from the recesses 28 of the cover plates 20, the cover plates 20 will pivot about the hinges 22, each about the respective axis P-P Because of the biasing force of a spring 30 associated with each hinge 22, the two cover plates 20 will pivot away from each other, from the position shown in FIG. 2, to that shown in FIG. 3, and eventually to that shown in FIGS. 4A and 4B.

Returning now to FIG. 3, because of the biasing force of a coil spring 32 associated with the button 24, when the inward pushing force asserted on the button 24 is released, the button 24 will return to the outer position, as shown in FIG. 3. When, therefore, the two cover plates 20 are pivoted back to the position shown in FIG. 2, e.g. by a user, the two recesses 28 will again engage the hooks 26 of the button 24, so that the cover plates 20 will be retained in the closed position until the button 24 is activated again.

As can be seen in FIGS. 4A and 4B, the cover plates 20 have a number of slots 34 allowing entry of air into the body 12. The cover plates 20 also serve the purpose of preventing some of the dust in the air from entering into the body 12, thus serving as a filter. As the cover plates 20 are movable, it is possible to actuate the button 24 to unlock the cover plates 20, so that the cover plates 20 pivot to the position shown in FIGS. 4A and 4B, allowing easy cleaning, e.g. cleansing.

It should be understood that the above only illustrates an example whereby the present invention may be carried out, and that various modifications and/or alterations may be made thereto without departing from the spirit of the invention.

It should also be understood that various features of the invention which are here, for brevity, described in the context of a single embodiment, may be provided separately or in any appropriate sub-combinations.

What is claimed is:

1. An electric hair dryer including a body with a first end allowing entry of air into said body, a second end allowing exit of said air from said body, and at least a cover member secured with said body and pivotably movable relative to said body between a first position in which at least part of said first end is blocked by said cover member and a second position in which said first end is substantially unobstructed by said cover member.

2. An electric hair dryer according to claim 1 wherein said cover member is hingedly secured with said body.

3. An electric hair dryer according to claim 1 including at least two cover members, each secured with a respective side of said body.

4. An electric hair dryer according to claim 3 wherein each said cover member is pivotally movable relative to said body about a respective axis substantially perpendicular to a longitudinal axis of said body.

5. An electric hair dryer according to claim 1 wherein said cover member is biased towards said second position.

6. An electric hair dryer according to claim 5 wherein said cover member is biased towards said second position by at least one spring member.

7. An electric hair dryer according to claim 1 further including an actuator with at least one engaging portion releasably engageable with said cover member to retain said cover member in said first position.

8. An electric hair dryer according to claim 7 wherein said actuator is movable between a locking position adapted to retain said cover member in said first position and an unlocked position allowing said cover member to move from said first position to said second position.

9. An electric hair dryer according to claim 7 wherein said actuator is movable between said locking position and said unlocked position along its longitudinal axis.

10. An electric hair dryer according claim 9 wherein said longitudinal axis of said actuator is substantially parallel to a longitudinal axis of said body.

11. An electric hair dryer according to claim 7 wherein said actuator is biased towards said locking position.

12. An electric hair dryer according to claim 7 wherein said actuator is biased towards said locking position by at least one spring member.

* * * * *